US009943138B1

(12) United States Patent
Koo

(10) Patent No.: US 9,943,138 B1
(45) Date of Patent: Apr. 17, 2018

(54) SHOE WITH EMBEDDED STRAP ANCHOR

(71) Applicant: Dynasty Footwear, Ltd., El Segundo, CA (US)

(72) Inventor: John C. S. Koo, Los Angeles, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 171 days.

(21) Appl. No.: 14/860,822

(22) Filed: Sep. 22, 2015

Related U.S. Application Data

(63) Continuation of application No. 12/464,812, filed on May 12, 2009, now Pat. No. 9,167,869, which is a continuation-in-part of application No. 12/098,814, filed on Apr. 7, 2008, now Pat. No. 9,167,868.

(60) Provisional application No. 60/910,652, filed on Apr. 7, 2007, provisional application No. 60/915,924, filed on May 3, 2007.

(51) Int. Cl.

| | |
|---|---|
| ***A43B 13/00*** | (2006.01) |
| ***A43B 13/20*** | (2006.01) |
| ***A43C 11/14*** | (2006.01) |
| ***A43C 11/00*** | (2006.01) |
| ***A43B 3/10*** | (2006.01) |
| ***A43B 7/14*** | (2006.01) |

(52) U.S. Cl.
CPC ..... *A43C 11/00* (2013.01); *A43B 3/102* (2013.01); *A43B 7/1495* (2013.01); *A43B 13/20* (2013.01); *A43C 11/14* (2013.01)

(58) Field of Classification Search
CPC ..... A43C 11/00; A43C 11/14; A43C 1/00; A43B 7/1495; A43B 13/20
See application file for complete search history.

(56) References Cited

U.S. PATENT DOCUMENTS

| | | | |
|---|---|---|---|
| 2,245,706 | A | 6/1941 | Nutt et al. |
| 2,297,594 | A | 9/1942 | Philip et al. |
| 2,297,595 | A | 9/1942 | Philip et al. |
| 2,368,314 | A | 1/1945 | Herman et al. |
| 2,434,024 | A | 1/1948 | Vlasak et al. |
| 2,538,170 | A | 1/1951 | Stritter et al. |

(Continued)

FOREIGN PATENT DOCUMENTS

| | | | | |
|---|---|---|---|---|
| EP | 0329392 | | 8/1989 | |
| GB | 428127 | | 4/1935 | |
| JP | 08131201 A | * | 5/1996 | ..... A43B 3/122 |

OTHER PUBLICATIONS

Prosecution history of parent U.S. Appl. No. 12/098,814.
Prosecution history of parent U.S. Appl. No. 14/860,822.

*Primary Examiner* — Jila M Mohandesi
(74) *Attorney, Agent, or Firm* — Joseph G. Swan, P.C.

(57) ABSTRACT

Provided are, among other things, shoes and shoe components, together with systems, methods and techniques for manufacturing the same. One representative embodiment involves a shoe that includes: a sole having a main structure; a strap anchor that has attachment points and is at least partially embedded within the main structure; and a strap that is attached to and/or looped through one or more of such attachment points and that is configured for strapping the shoe to a wearer's foot. Also, in this embodiment, the strap anchor includes a number of strap anchor components attached in a unit, each such strap anchor component including a number of the attachment points and being at least partially embedded within the main structure.

18 Claims, 10 Drawing Sheets

(56) References Cited

U.S. PATENT DOCUMENTS

| | | | | |
|---|---|---|---|---|
| 4,843,736 | A * | 7/1989 | Courian | A43B 3/105 36/11.5 |
| 5,247,741 | A * | 9/1993 | Pastor | A43B 3/108 12/142 S |
| 5,271,130 | A | 12/1993 | Batra | |
| 5,991,950 | A | 11/1999 | Schenkel | |
| 6,029,376 | A | 2/2000 | Cass | |
| 7,343,701 | B2 | 3/2008 | Pare et al. | |
| 7,500,323 | B2 | 3/2009 | Rasmussen | |
| 7,823,299 | B1 * | 11/2010 | Brigham | A43B 3/105 36/100 |
| 2004/0181972 | A1 * | 9/2004 | Csorba | A43B 7/1495 36/50.1 |
| 2006/0026861 | A1 * | 2/2006 | Manzi | A43B 3/122 36/11.5 |
| 2006/0130363 | A1 | 6/2006 | Hottinger | |
| 2006/0196080 | A1 | 9/2006 | Kelley | |
| 2007/0011914 | A1 | 1/2007 | Keen et al. | |
| 2007/0068041 | A1 | 3/2007 | Farys | |
| 2008/0040949 | A1 | 2/2008 | Moseley | |
| 2008/0052964 | A1 | 3/2008 | Taylor | |
| 2010/0223812 | A1 * | 9/2010 | Batanero Bastida | A43B 3/103 36/100 |

* cited by examiner

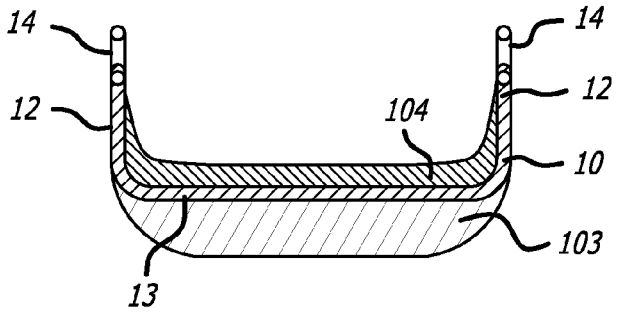
FIG. 3
FIG. 4
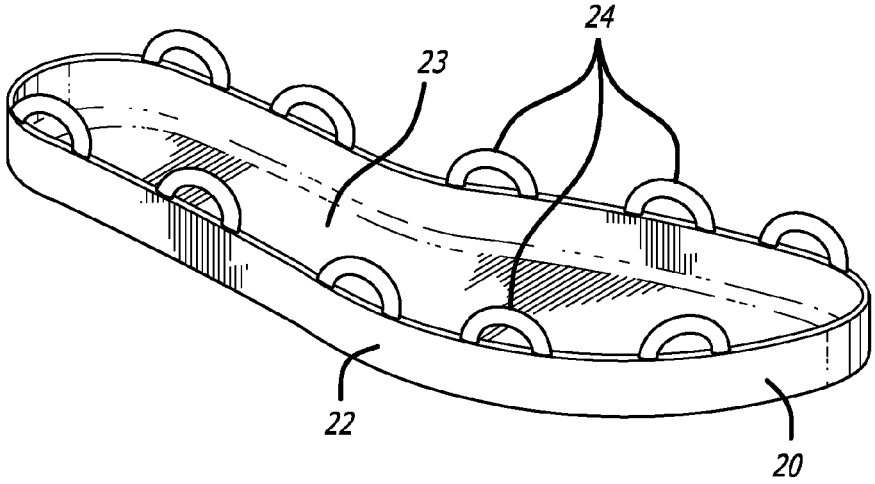
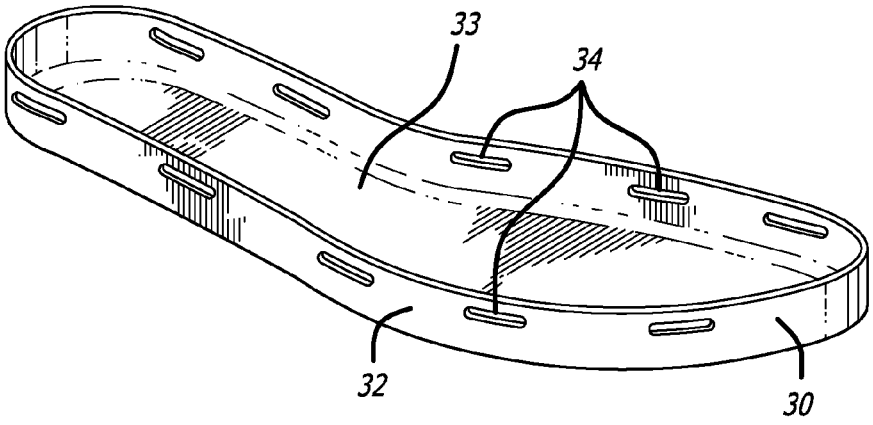
FIG. 5

FIG. 10
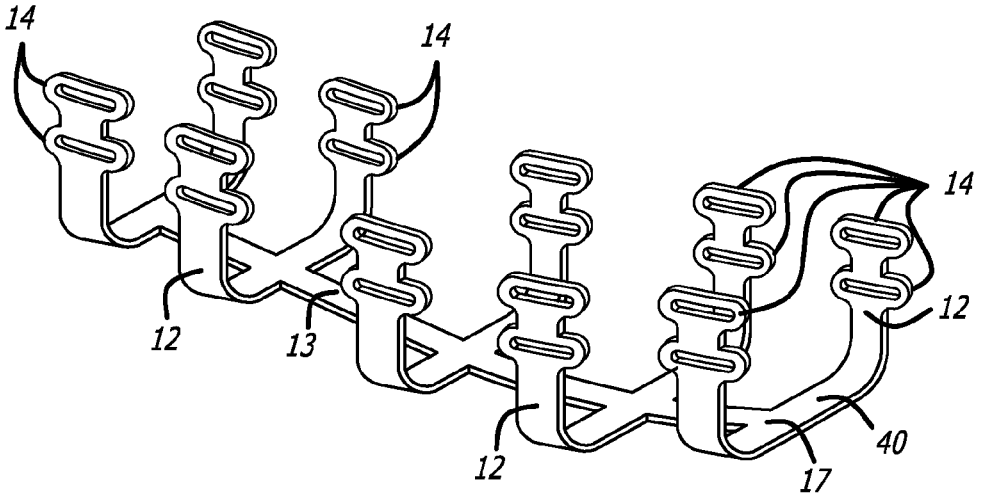
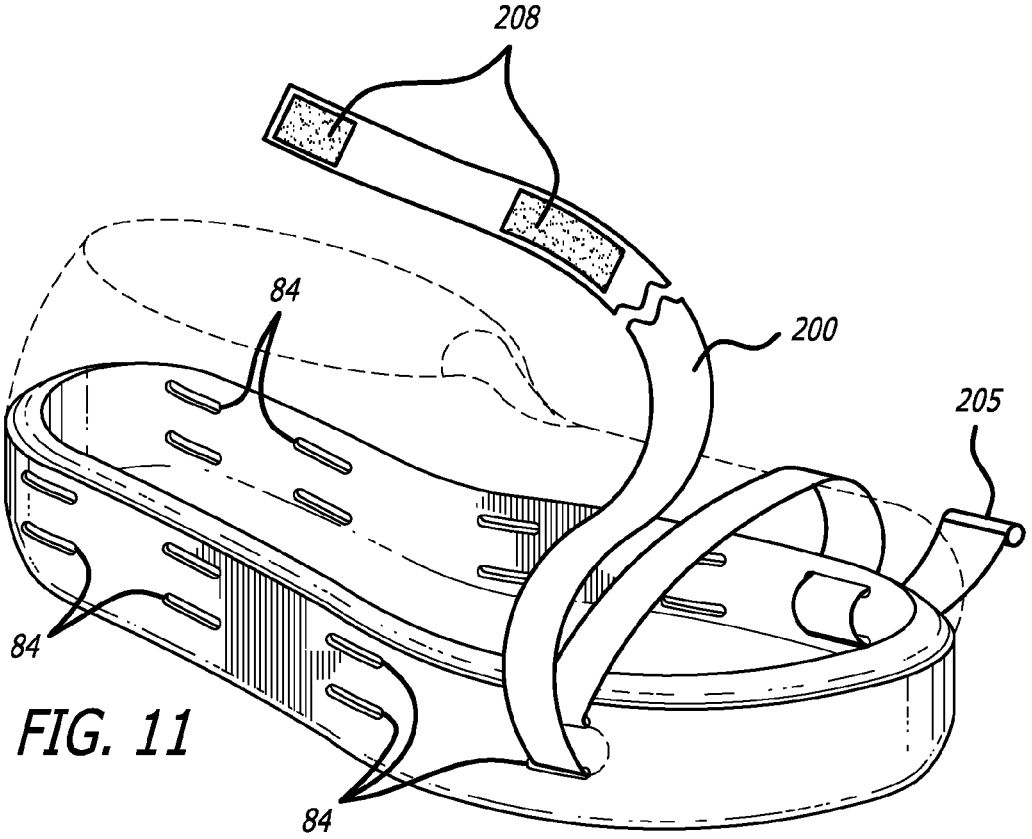
FIG. 11

SHOE WITH EMBEDDED STRAP ANCHOR

This application is a continuation of U.S. patent application Ser. No. 12/464,812, filed May 12, 2009, which is a continuation-in-part of U.S. patent application Ser. No. 12/098,814, filed on Apr. 7, 2008, and titled "Shoe with Embedded Strap Anchor" (the '814 application); the '814 application, in turn, claimed the benefit of U.S. Provisional Patent Application Ser. No. 60/910,652, filed on Apr. 7, 2007, and titled "Embedded Strap Anchor", and U.S. Provisional Patent Application Ser. No. 60/915,924, filed on May 3, 2007, and also titled "Embedded Strap Anchor"; the foregoing applications are incorporated by reference herein as though set forth herein in full.

FIELD OF THE INVENTION

The present invention pertains to shoes/footwear.

BACKGROUND

A variety of different kinds and styles of shoes exist. However, new and improved designs continuously are desirable. Toward this end, the '814 application discloses a variety of shoe construction designs and corresponding methods for manufacturing a shoe. The present invention expands on the teachings of the '814 application.

SUMMARY OF THE INVENTION

In particular, the present invention provides, among other things, shoes and shoe components that include a multi-component strap anchor, together with systems, methods and techniques for manufacturing the same.

One representative embodiment involves a shoe that includes: a sole having a main structure; a strap anchor that has attachment points and is at least partially embedded within the main structure; and a strap that is attached to and/or looped through one or more of such attachment points and that is configured for strapping the shoe to a wearer's foot. Also, in this embodiment, the strap anchor includes a number of strap anchor components attached in a unit, each such strap anchor component including a number of the attachment points and being at least partially embedded within the main structure.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

FIG. 3 is a front cross-sectional view of a shoe sole that has been assembled as shown in FIG. 1.

FIG. 4 is a perspective view of an alternate strap anchor 20 having a continuous sidewall 22, an overall shape that approximates the overall shape of the shoe's sole, and loops 24 extending above the sidewall 22.

FIG. 5 is a perspective view of another alternate strap anchor 30 having a continuous sidewall 32, an overall shape that approximates the overall shape of the shoe's sole, and slots 34 formed into the sidewall 32.

FIG. 10 illustrates a strap anchor 40 according to an alternate embodiment of the invention, in which pairs of slots 14 are provided.

FIG. 11 illustrates an example of a shoe sole having pairs of slots 84.

DESCRIPTION OF THE PREFERRED EMBODIMENT(S)

Figure 1:
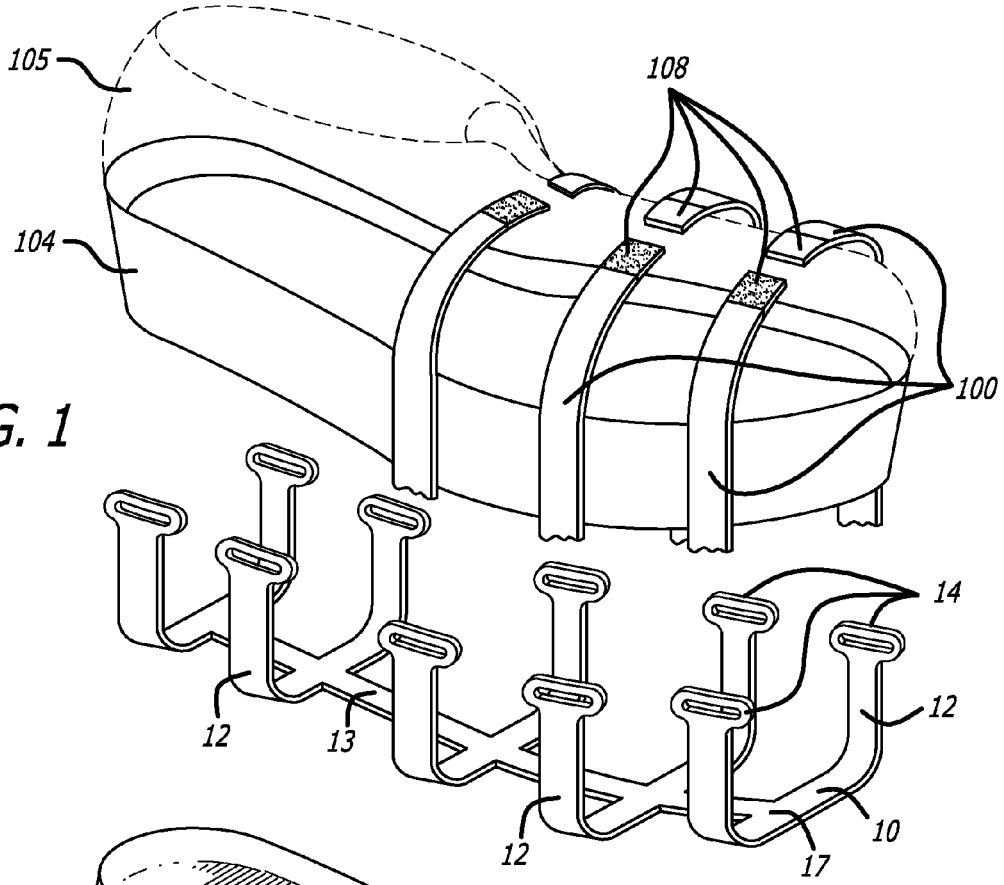
FIG. 1 is an exploded view of a shoe sole (with an upper 105 shown in phantom) in which a strap anchor 10, having a fishbone configuration with arms 12 extending from a main body portion 13 and terminating in loops 14, is bonded between layers 103 and 104 of a base material.

The present disclosure is divided into sections, with the first section describing certain general aspects of a shoe, shoe sole and/or strapping system according to the present invention. The second section describes a bonding technique for manufacturing a shoe sole according to the present invention, as well as the resulting shoe sole. The third section describes a molding technique for manufacturing a shoe sole according to the present invention, as well as the resulting shoe sole. The fourth section describes certain alternate strapping configurations. The fifth section describes multi-component (e.g., adjustable-length) strap anchors. The sixth section describes certain additional considerations pertaining to the present invention.

General Discussion.

The present invention provides for a strap anchor (e.g., strap anchor 10, 20, 30 or 40) having a main body (or anchoring portion, e.g., anchoring portion 13, 23 or 33) that is embedded into, and therefore forms a part of, the sole of a shoe (or other item of footwear, collectively referred to as a "shoe" herein). In the preferred embodiments, the sole of the shoe is made of a very lightweight base material, such as a natural or synthetic material (e.g., any of the materials mentioned below) that has been "blown" with air while in liquid or semi-liquid form, thereby creating a number of small air pockets, so as to make the material more cushiony and less dense. Alternatively, or in addition, a mixture of different compounds or other materials may be used so as to increase or decrease the overall density (e.g., with different compounds blended together so that each is indistinguishable from the others, with pieces of less dense cushioning material mixed in but retaining their separate identities, and/or with pieces of less desirable material, such as recycled rubber or other recycled material, mixed in but retaining their separate identities). The upper of the shoe (if any), other than any straps for tightening the shoe, preferably also is made of a very lightweight material, such as a "blown" natural or synthetic material.

The strap anchor (e.g., strap anchor 10, 20, 30 or 40), on the other hand, preferably is made of a stronger and more durable material than that of the base material for the shoe's sole or the material from which the shoe's upper is fabricated. Examples of such materials include any combination of: a fiberglass or fiber-wrapped pre-shaped board, a high-durometer ethylene vinyl acetate (EVA), polyvinyl chloride (PVC), thermoplastic rubber (TPR), or any other plastic, natural or synthetic rubber or polymer. In the preferred embodiments, in order to reduce manufacturing costs, the strap anchor (e.g., strap anchor 10, 20, 30 or 40) is manufactured as a unitary piece from a single type of material. However, in alternate embodiments, the strap anchor is assembled from different pieces (e.g., glued or bonded together for molding), and/or different kinds of materials are used to fabricate the strap anchor, e.g., a stronger, harder or more rigid material for the strap-attachment points (e.g., strap-attachment points 14, 24 or 34), such as metal rings or hooks, than is used for the anchoring portion 13, 23 or 33.

With reference to strap anchor 10 as an example, in a representative embodiment the anchoring portion 13 of the strap anchor 10 has a central elongated backbone section (e.g., in the shape of an elongated rectangle) from which a number of projections or arms 12 extend at approximately right angles from its sides, so that the entire strap anchor 10 resembles a fish skeleton. Such a fishbone structure often will provide additional structural integrity to the rest of the sole. It is noted that the number and configuration of arms 12 shown in FIG. 1 is merely exemplary; any other number and configuration of arms 12 instead may be used. For instance, the arms 12 may be selectively designed to apply structural support as desired and/or to ensure that the strap-attachment points 14 are appropriately positioned for desired strapping pressure points. With regard to the former, it is noted that the arms 12 may be used as a part of the shoe's upper 105 (e.g., to assist in holding the upper onto the wearer's foot).

Alternatively, with reference to strap anchor 20 or 30 as an example, in an alternate embodiment the anchoring portion (or main body) of the strap anchor (i.e., anchoring portion 23 or 33, respectively) is configured as a substantially solid piece, e.g., having a shape that at least roughly matches the shape of the shoe's sole. In still further embodiments, the anchoring portion of the strap anchor may have any other configuration.

Also, the anchoring portion 13, 23 or 33 (or, more generally, the entire strap anchor 10, 20, 30 or 40) may be provided with other structural characteristics that are desirable for the particular shoe being manufactured. For example, the front portion 17 of strap anchor 10 may be thicker, broader, wider, fabricated from a stronger and/or more rigid material, or otherwise stronger and/or more rigid, so as to provide additional toe strength and/or support for the resulting shoe. In one such representative embodiment, the front portion 17 of the anchoring portion 13 of strap anchor 10 (or, e.g., the front portion of the entire strap anchor 10, 20, 30 or 40) includes a strong and/or rigid toe cap (e.g., made of Kevlar™ or another strong material). As a result, a very lightweight climbing shoe or work shoe can be made. Similarly, anchoring portion 13, 23 or 33 may be provided with a stronger and/or more rigid rear portion to protect the wearer's heel.

In addition to its anchoring portion, e.g., 13, 23 or 33 (i.e., the portion that is embedded within the shoe sole's base material), the strap anchor (e.g., strap anchor 10, 20, 30 or 40) also has a number of hooks, loops, slots or other strap-attachment points (e.g., loops 14 or 24 or slots 34) that extend up from the sole on the left and right sides thereof. In the preferred embodiments, the entire structure of the strap anchor (e.g., strap anchor 10, 20, 30 or 40) is rigid, semi-rigid or at least shape-retaining.

Conventional shoes made entirely of lightweight material generally have been limited to sandals and other slip-on shoes because they are not capable of withstanding the stresses that would result from using straps, laces or other tightening mechanisms. However, by using a strap anchor according to the present invention (with its main body, e.g., anchoring portion 13, 23 or 33, embedded within the shoe's sole) and by securing one or more straps (e.g., straps 100 or single strap 200) to the upper strap-attachment points (e.g., strap-attachment points 14, 24 or 34) of the strap anchor (e.g., strap anchor 10, 20, 30 or 40), the entire shoe can be tightened without imposing any significant stress on the main body of the shoe (sole or upper). Instead, most or all of the stress preferably is imparted to the strap anchor (e.g., strap anchor 10, 20, 30 or 40). As a result, in certain embodiments the user can have the feel of a very lightweight shoe while still having the benefit of being able to securely strap the shoe to his or her foot. It is noted that the strap-attachment points 14, 24 or 34 preferably are selectively positioned so that the straps (e.g., straps 100 or single strap 200) cross the wearer's foot and provide pressure at appropriate locations.

Preferably, the straps themselves (e.g., straps 100 or single strap 200) are made of a strong durable material. Examples include nylon, natural or synthetic rubber, string or the like; alternatively, ordinary shoelaces may be used.

Bonding Construction.

Figure 2:
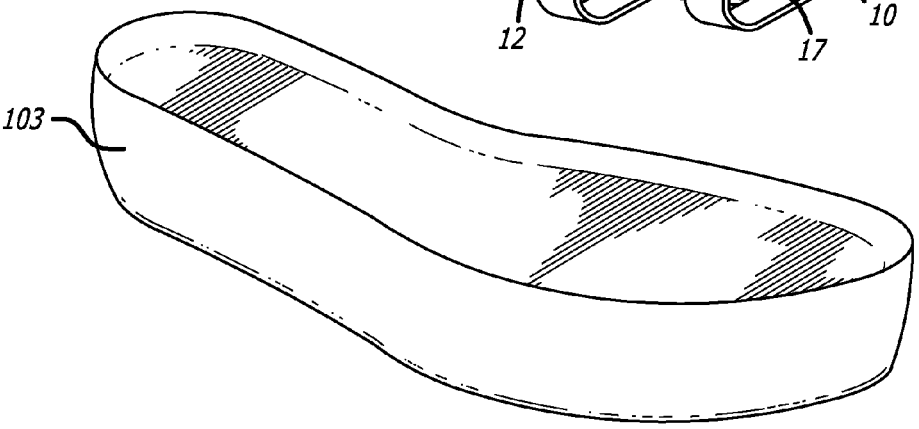
FIG. 2 is a perspective view of a shoe sole that has been assembled as shown in FIG. 1.
Figure 2:
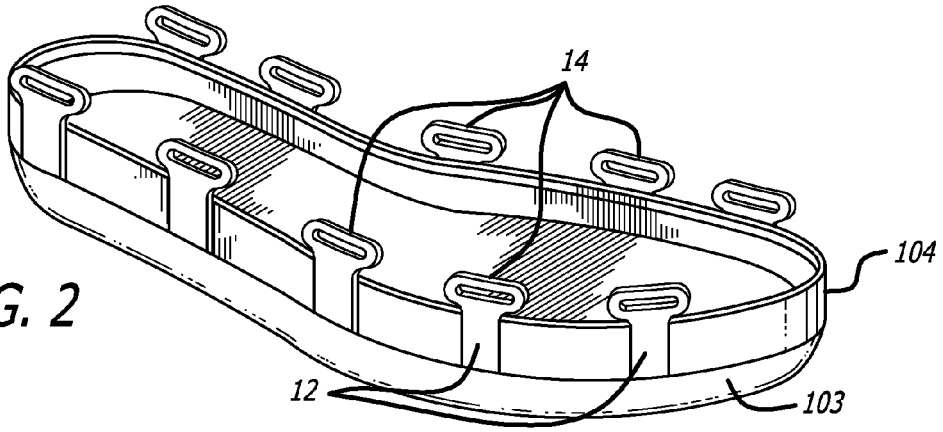

In one representative embodiment, an example of which being illustrated in FIGS. 1 and 2, the anchor portion 13 of the strap anchor 10 is inserted into the shoe's sole by gluing or otherwise bonding it in between two layers 103 and 104 of the sole's base material, with the arms 12 (which terminate in strap-attachment points 14) extending out and up from the sides of the sole. In this embodiment, the strap-attachment points 14 of the strap anchor 10 typically will extend along the outside perimeter of the top portion of the shoe's sole and, unless separately coated with material to match the sole's base material (i.e., the material forming layers 103 and 104), typically will have a different appearance and/or texture than the shoe's sole.

Once a shoe sole has been assembled in this manner, an upper 105 may be bonded to it. Alternatively, the upper 105 may already have been attached to layer 104, so that the entire shoe is completed upon bonding strap anchor 10 in between layers 103 and 104. Still further, the upper previously may have been attached to strap anchor 10 (e.g., by stitching, gluing and/or otherwise bonding), so once again the entire shoe is completed upon bonding strap anchor 10 in between layers 103 and 104. Finally, a separate upper 105 may be omitted entirely. In any event, a strapping system preferably is used for tightening the resulting shoe. In the embodiment shown in FIG. 1, multiple individual straps 100 are provided and the proximal end of each is attached at some point during the manufacturing process to one of the strap-attachment points 14, such as by looping its proximal end through a strap-attachment point 14 and then sewing the end of strap 100 into a loop. In alternate embodiments, some examples of which being discussed in more detail below, some or all of the straps 100 do not fixedly attach to any of the strap-attachment points (e.g., strap-attachment points 14, 24 or 34), but instead merely loop through such strap-attachment points.

The distal end of each strap 100 preferably is provided with an attachment mechanism 108, such as a high-density hook-and-loop mechanism (e.g., as is commonly sold under the brand name Velcro™), a clip mechanism, a hook mechanism, a belt-tightening mechanism or any other attachment mechanism. Alternatively, an attachment mechanism 108 may be omitted entirely, so that the user simply ties the distal ends of opposing straps 100 (e.g., where straps 100 are shoelaces). In the present embodiment, individual straps 100 attach (e.g., permanently) to strap-attachment points (e.g., strap-attachment points 14, 24 or 34) on opposite sides of the shoe and then opposite straps are pulled together and secured (e.g., using the provided attachment mechanism) in order to effect the desired tightening. However, it should also be noted that any other kind of strapping arrangement instead may be used, such as the use of strap 200, described below.

In the event that a separate upper (e.g., upper 105) is provided, the straps preferably go over the top of the upper, thereby securing the wearer's foot to both the shoe's upper and to its sole. For this purpose, the strap(s) may be threaded through slits or other openings in the upper, or the strap(s) may simply extend across the top of the upper without engaging it. Otherwise, e.g., in the case of a sandal, the straps may simply rest on the top of the sole when not in use, and then the wearer simply slips his or her foot beneath the straps and then tightens the straps to secure his or her foot to the shoe.

Although strap anchor 10 is shown in FIGS. 1-3, either of strap anchor 20 (shown in FIG. 4) or strap anchor 30 (shown in FIG. 5), or any other configuration of strap anchor, may be substituted for strap anchor 10 in this embodiment of the invention. In fact, the front cross-sectional view of the shoe sole generally will have the same appearance shown in FIG. 3 irrespective of which of strap anchors 10, 20, 30 or 40 is used.

The simple bonding procedure (shown in FIGS. 1-3) has the advantage that no special equipment generally is required. However, one characteristic of this construction is that the arms 12 (or sidewall 22 or 32) typically will extend (and therefore be visible) along the outside of the upper layer 104 of the shoe's sole. In order to address this problem, lower layer 103 may be provided with upwardly extending sidewalls that cover arms 12 (or sidewall 22 or 32), or foxing may be bonded around the outer perimeter of the shoe's sole to cover arms 12 (or sidewall 22 or 32). Also, the arms 12 may be made very short, e.g., extending only slightly upwardly as part of the shoe's sidewall, so that it does not extend much (if at all) above the shoe's sole.

Other characteristics of this kind of construction are: (1) the existence of seams between the layers 103 and 104 and (2) as noted above, the fact that at least the strap-attachment points 14, 24 or 34 often will have a different appearance than the rest of the sole's base material. In this latter regard, it is noted that the strap-attachment points 14, 24 or 34 generally cannot be easily covered without interfering with their intended function; they can be coated, although that typically would require an additional manufacturing step, which typically also would impose additional cost.

Molding Construction.

Figure 6:
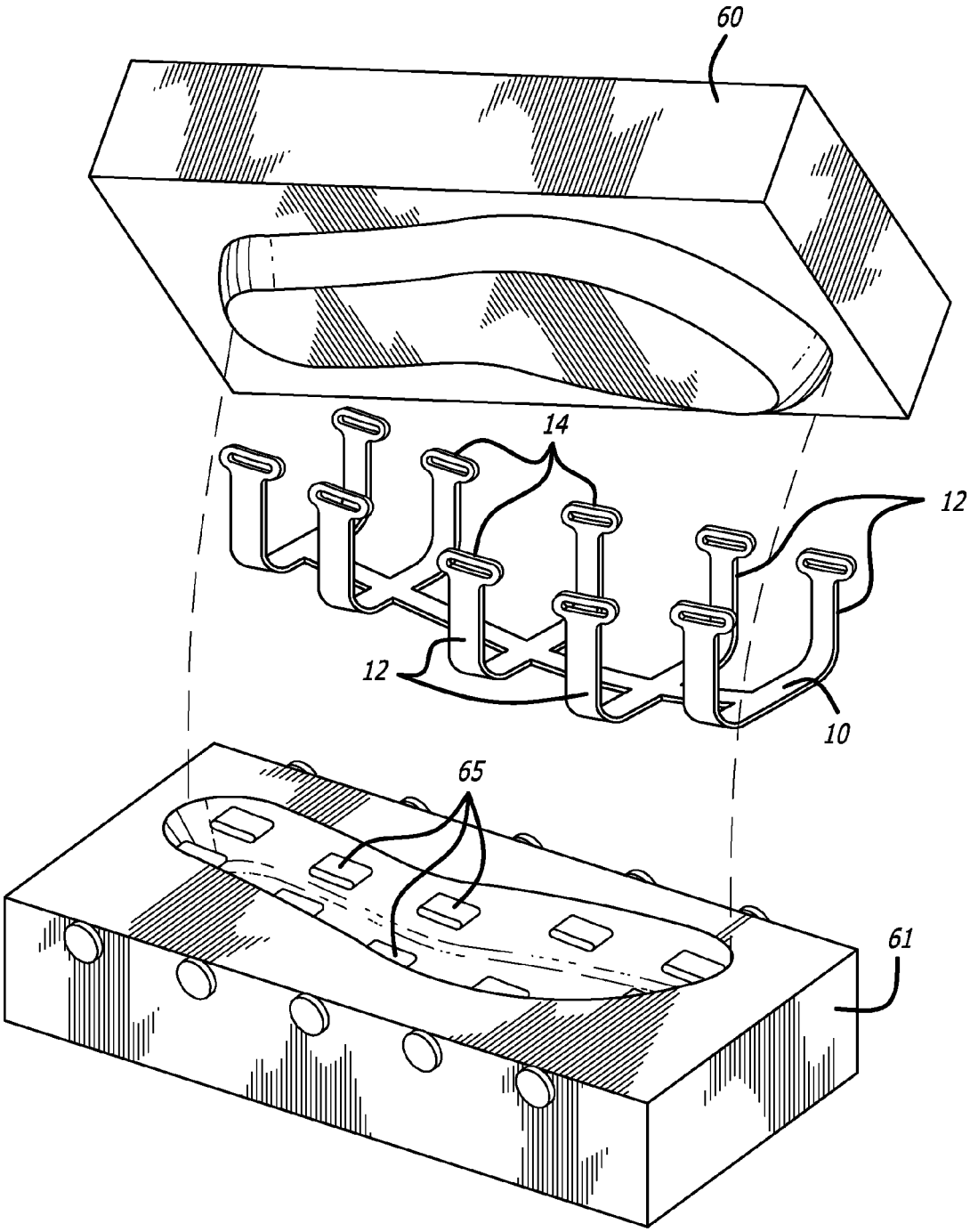
FIG. 6 is an exploded perspective view illustrating how an outsole can be molded with an embedded strap anchor 10.
Figure 7:
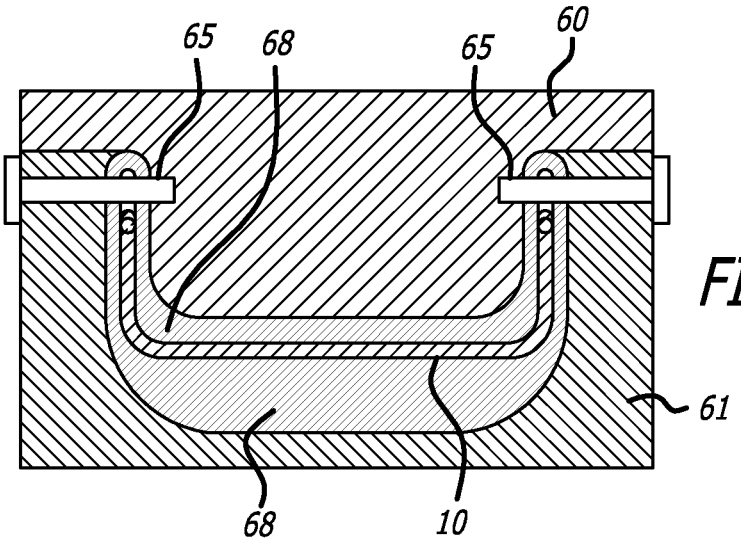
FIG. 7 is a front cross-sectional view showing strap anchor 10 installed within a shoe sole mold (comprising an upper portion 60 and a lower portion 61), with the shoe mold closed and with injection material 68 occupying the interior portion of the mold.

In an alternate embodiment, the anchor portion (e.g., anchoring portion 13, 23 or 33) of the strap anchor (e.g., strap anchor 10, 20, 30 or 40) is molded into the shoe's sole, e.g., by placing or suspending it into a mold and then injecting in the base material. An example of this embodiment is illustrated in FIGS. 6-7. In this embodiment, a mold is used to form the shoe's sole, the mold having an upper portion 60 and a lower portion 61. The mold (e.g., the lower portion 61 of the mold) preferably is provided with tabs 65 from which the strap anchor 10 is suspended using loops 14 (or using, e.g., whatever hooks, loops or slots are provided as strap-attachment points on the strap anchor).

As noted above, the strap anchor 10 preferably is shape-retaining so that it may be installed within the lower portion 61 of the mold by bending the arms 12 slightly inwardly and then fitting loops 14 onto tabs 65. In the preferred embodiments, tabs 65 fit snugly within loops 14. For this purpose, tabs 65 may be tapered, e.g., narrower at their distal ends and wider at their proximal ends, so that it is easy to initially install strap anchor 10 and then, by pressing the arms 12 toward the inner wall of lower portion 61, to obtain a secure fit.

In this manner, referring to FIG. 7 and bearing in mind that strap anchor 10 preferably is shape-retaining, the strap anchor 10 remains suspended within the lower portion 61 of the mold. Next, the mold is closed by attaching upper portion 60 to lower portion 61, and injection material 68 is injected into the mold. Ordinarily, the injection material 68 fills all portions of the inner cavity between upper portion 60 and lower portion 61 of the mold, completely surrounding and encasing strap anchor 10. Slots 65 serve the purpose of suspending strap anchor 10 within the mold while simultaneously ensuring that the loop openings 14 are not filled with the injection material 68.

By using this technique, the anchoring portion 13 of the strap anchor 10 is suspended within the shoe's sole during the injection process, so that it will be completely embedded and hidden from view in the final product. At the same time, the strap-attachment points 14 of the strap anchor 10 also will be coated with the same base material that is used to form the rest of the shoe's sole (other than a small area where each strap-attachment point 14 contacts the tabs 65 of the mold, i.e., on the underside of the top portions of the respective strap-attachment points 14, which area in any event is mostly hidden from sight). The result is a more uniform appearance for the shoe's sole and strap-attachment points 14 than is achieved with the bonding technique described above. In the present embodiment, strap-attachment points 14 typically appear to be a more integral feature of the shoe's sole.

Figure 8:
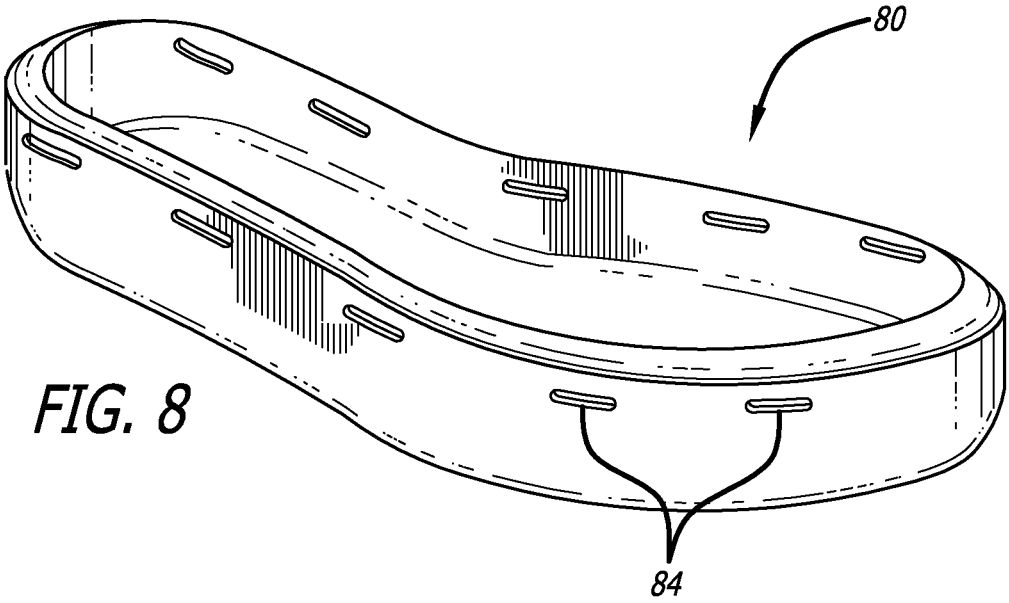
FIG. 8 is a perspective view of a shoe sole that has been made as shown in FIGS. 6 and 7.

An example of a shoe sole 80 that has been manufactured in accordance with this process is illustrated in FIG. 8. As shown, the sole 80 appears to be a single unitary piece with slots 84 that serve as strap-attachment points. Strap anchor 10 is completely hidden from view but provides a means for securely attaching a strapping system to the shoe.

All of the same considerations discussed above in connection with the bonding embodiment, with respect to the shape of the strap anchor 10, 20, 30 or 40 and/or the anchoring portion 13, 23 or 33 thereof, also apply with respect to the molding embodiment. In addition, it often is possible to achieve greater flexibility with the present molding technique. For example, when molding strap anchor 10, 20, 30 or 40 into the sole of a shoe, the strap anchor 10, 20, 30 or 40 can have a more or less arbitrary shape, with the injection material 68 simply filling in around the embedded portion of the strap anchor 10, 20, 30 or 40. Accordingly, additional structural support and/or reinforcement can be provided where and as desired, generally subject only to the requirement that the portion of the strap anchor 10, 20, 30 or 40 that is intended to be embedded actually fit within the shoe's sole. In contrast, in the bonding technique described above, the upper layer 104 and the lower layer 103 and generally need to be shaped to accommodate the shape of the corresponding anchoring portion 13, 23 or 33.

In addition, in certain embodiments in which the shoe's sole and its upper are molded together (e.g., using a two-piece mold), any portion of the arms 12 or sidewall 22 or 32 can be extended up into the shoe's upper, providing additional structural support and/or reinforcement as desired. At the same time, by molding the shoe's sole and/or upper around some or all of the strap anchor 10, 20, 30 or 40, it can be substantially or even completely hidden from view, thereby allowing a designer to achieve a wide range of aesthetic effects while still providing desired functional qualities. As noted above, such additional structural support can be used for manufacturing a work shoe or a shoe having specific technical requirements, such as a climbing shoe, a bicycling shoe or a river shoe.

Once the sole 80 has been completed, it can be attached to an upper, e.g., by gluing, otherwise bonding, or molding the upper onto the sole 80. Alternatively, by using an appropriately shaped (e.g., two-piece) mold, the upper and sole 80 may be molded together in a single operation (in which case the upper can be a different color or have different physical properties, if desired, by using a different injection material for the upper than is used for the sole). Still further, the upper may be stitched, glued or otherwise bonded to the strap anchor prior to molding the strap anchor into the shoe's sole. Finally, a separate upper may be omitted entirely in favor of just providing a strapping system, thereby resulting in a sandal or sandal-like shoe. In any event, straps (e.g., any of the straps described herein) preferably are used and attached to strap-attachment points 14 (either permanently or by simply looping them through). In the present embodiments, in which the strap anchor 10 is molded into the shoe's sole 80, the upper (if provided) preferably is made of the same material and has the same, similar or complementary color, design and aesthetic appearance as the shoe's sole 80.

It is noted that any kind of strap anchor may be molded into a shoe's sole in this manner. For example, strap anchors similar to anchor 20 (shown in FIG. 4) or anchor 30 (shown in FIG. 5) may be used. However, in such a case, the bottom surface of the corresponding anchoring portion 23 or 33 preferably is provided with slots or other kinds of openings in order to allow the injection material 68 to easily flow through and around the strap anchor 20 or 30, respectively.

It is further noted that, by appropriate layering or other known molding techniques, different kinds of base material can be injected to form the shoe's sole, e.g., one kind for the lower portion of the shoe's sole (e.g., the portion generally beneath the strap anchor) and another kind for the upper portion of the shoe's sole (e.g., the portion generally above the sole's upper). In this way, e.g., the sole can have a more durable bottom portion and a softer or more cushiony top portion (where the wearer's foot normally would rest), if desired. Also, by using appropriate molding techniques, the shoe's sole and/or upper can be formed with openings or holes, e.g., to allow ventilation.

In the embodiments described above, the strap anchor 10, 20, 30 or 40 is suspended in the mold using the corresponding strap-attachment points 14, 24 or 34. However, in alternate embodiments, the strap anchor is simply deposited into the mold or otherwise attached to the mold, e.g., using a mold having appropriate support nodules or the like. In such as case, portions of the strap anchor 10, 20, 30 or 40 generally will be exposed, e.g., within an indentation at the bottom of the shoe's sole, and either can be left exposed or can be covered, e.g., by bonding a plug into the indentation.

Still further, in a similar manner, a piece can be molded within the shoe's sole, even if the piece does not provide strap-attachment points. For example, such a piece might be used to provide the additional structural support or other functional benefits described above.

Alternate Strapping Configurations.

Figure 9:
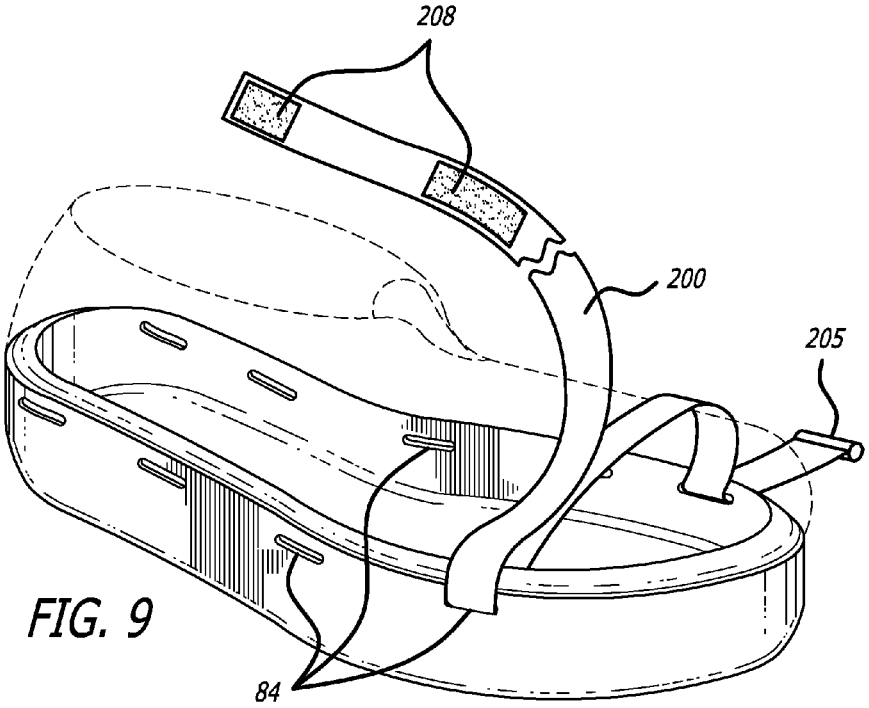
FIG. 9 illustrates an example of a strapping system that can be used in accordance with a shoe sole having an embedded strap anchor according to the present invention.

Referring to FIG. 9, one specific embodiment of the present invention uses a single removable strap 200 having an anchor 205 at one end and an attachment mechanism 208 (e.g., a high-density hook-and-loop attachment mechanism, such as is commonly sold under the brand name Velcro™) at the other end. Such a strap is described more fully in commonly assigned U.S. patent application Ser. No. 11/695,578 (the '578 application), which application is incorporated by reference herein as though set forth herein in full. In the embodiment illustrated in FIG. 9, the anchor 205 is an enlarged, preferably rigid element that prevents the strap 200 from being pulled through the first slot into which it is inserted. For that purpose, the slot against which anchor 205 abuts preferably is provided with a matching groove for accommodating anchor 205, e.g., so that anchor 205 does not protrude from the side of these shoe's sole.

Alternatively, anchor 205 may be implemented as an attachment mechanism, e.g., one that detachably attaches to the outer surface of the shoe's sole (e.g., a high-density hook-and-loop attachment mechanism). Once again, the area surrounding the slot against which such alternate attachment mechanism 205 abuts (e.g., a portion of the outer surface of the shoe's sole) may be grooved or otherwise indented to accommodate the attachment mechanism 205, e.g., so that the attachment mechanism 205 does not protrude.

In this embodiment, the removable strap 200 is looped from side to side through the strap-attachment points (e.g., strap-attachment points 84) of the strap anchor (e.g., embedded strap anchor 10, which is hidden from view in FIG. 9) and is used to tighten the shoe in a similar manner to that described in the '578 application. In the present embodiment, strap 200 has a high-density hook-and-loop attachment mechanism 208. However, in alternate embodiments any other kind of attachment mechanism 208 instead may be used (e.g., any of the other attachment mechanisms described herein).

It is noted that the shoe's strap(s) (e.g., 100 or 200) may be threaded through, otherwise removably attached to, permanently attached to, or completely unconnected to the rest of the shoe's upper. For example, slots may be provided in the upper to permit the strap 202 enter and exit the interior of the shoe (e.g., one for each of slots 84). The actual interaction between the shoe's strap(s) and the rest of the shoe's upper (if any), as well as whether any additional upper structure is provided at all, preferably depend mainly on aesthetic considerations, but in some cases on functional considerations as well. If an upper is provided, the strap 200 preferably passes over the top of the upper.

FIG. 10 illustrates a strap anchor 40 according to an alternate embodiment of the invention, in which a pair of vertically offset horizontal slots 14 is provided on each arm 12. Although the slots making up each such pair generally are illustrated as being horizontally aligned with each other, in alternate embodiments of the invention some horizontal offset is used (e.g., in order to guide the strap toward the next loop on the opposite side of the shoe). It is noted that strap anchor 40 can be embedded into a shoe's sole using either the bonding technique or the molding technique described above. In the latter case, the arrangement of tabs 65 preferably matches the arrangement of slots 14, at least with respect to those slots 14 that are not intended to be filled with injection material 68.

FIG. 11 illustrates an example of a shoe sole that has been manufactured by molding strap anchor 40 into the shoe's sole. As shown, the pairs of slots 84 allow the strap 200 to enter and exit the interior of the shoe (where a separate upper has been provided). In one of the embodiments discussed above, a similar result is achieved by using single slots in the strap anchor but including slots or other kinds of openings in the shoe's upper. The choice as to which approach to use preferably depends upon the expected stress that is to be imparted by the strap 200 and the strength of the upper material as compared to the material of the strap anchor that is used.

It is further noted that the strap anchor 40 is merely exemplary and any other configuration of strap anchor may be designed with similar pairs of closely spaced slots or loops, e.g., by modifying each of loops 24 to instead include a double loop or by modifying strap anchor 30 to have closely spaced pairs of slots 34.

More generally, the strap anchors described above should be understood as being merely exemplary. Various other configurations also may be used. For instance, rather than a single strap anchor component, a strap anchor according to the present invention can include a plurality of U-shaped strap anchor components, each terminating in a loop 14 at each of its ends; here, the appearance would be similar to strap anchor 10, but with the omission of the central spine 13.

Once the shoe's sole has been completed, the shoe's strap(s) may be looped through, or attached to, the strap-attachment points. The rest of the upper (if any) is attached to the sole, e.g., by gluing or otherwise bonding it.

Multi-Component Strap Anchor.

In the embodiments discussed above, the strap anchor generally is described and depicted as a single unitary component. In contrast, the embodiments described in the present section generally involve a multi-component strap anchor, e.g., one in which two or more strap anchor components attach lengthwise to each other at any of multiple different positions, thereby allowing for adjustment of the overall length of the strap anchor. One benefit of an adjustable-length strap anchor is that a single configuration often can be used for shoes of different sizes. As a result, manufacturing costs usually can be reduced, e.g., by avoiding the necessity of producing injection molds for strap anchors having different sizes.

Figure 12:
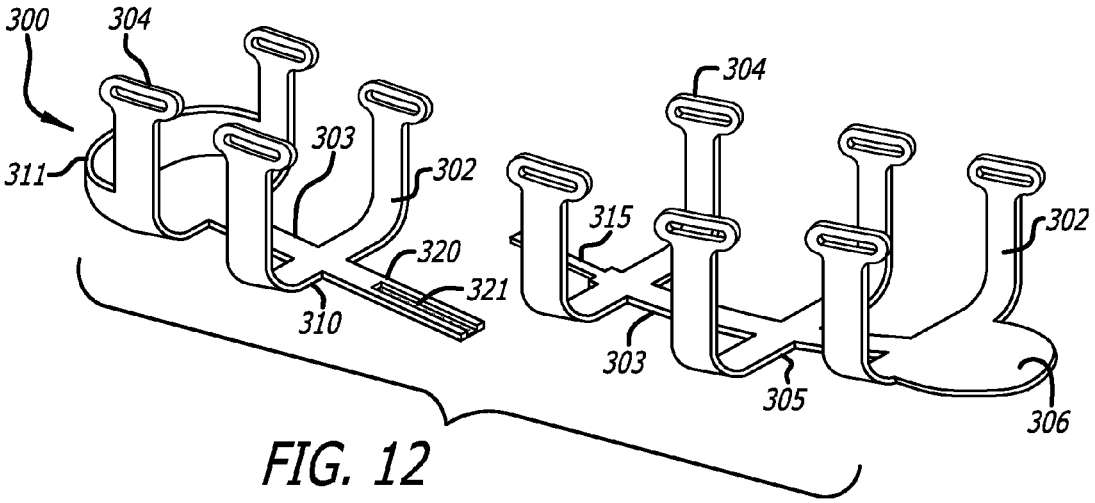
FIG. 12 is a perspective view of the separate components of a strap anchor according to a representative embodiment of the present invention.
Figure 13:
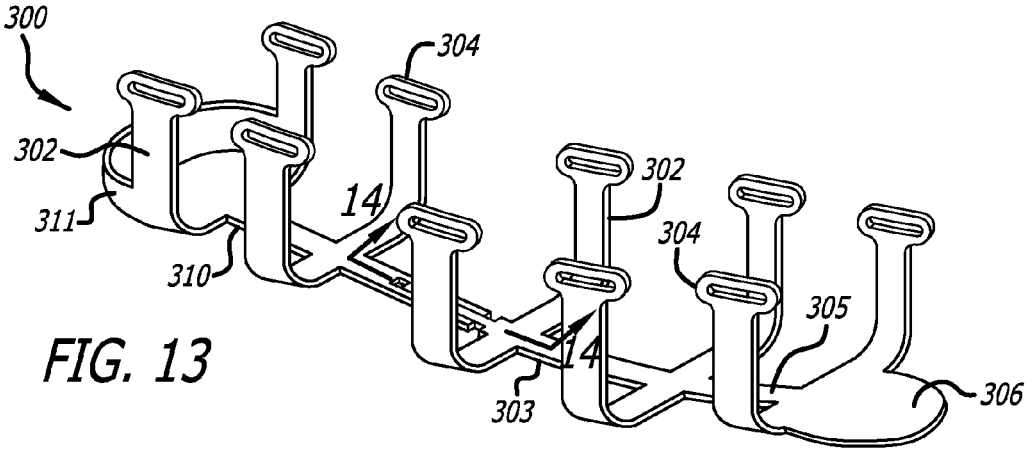
FIG. 13 is a perspective view of an assembled strap anchor using the components illustrated in FIG. 12.
Figure 14:
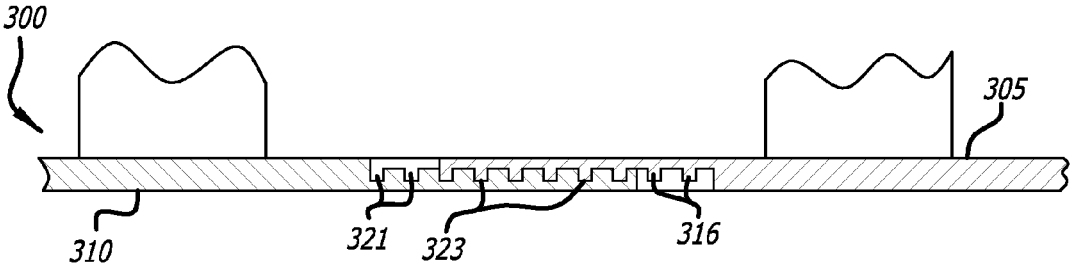
FIG. 14 is a cross-sectional view of a portion of the strap anchor shown in FIG. 13.

According to a first embodiment of a multi-component strap anchor 300, illustrated in FIGS. 12-14, a front component 305 and a rear component 310 are assembled together in order to form the entire strap anchor 300. As with the other strap anchors described above, strap anchor 300 preferably includes a main body portion (here, the main body portion 303), typically configured as an elongated backbone section, from which arms (here, arms 302) extend, each terminating in a strap-attachment point (here, strap-attachment points 304). However, in the present embodiment the arms 302, together with their respective strap-attachment points 304, are provided in two separate components, the front component 305 and the rear component 310.

In the present embodiment, each of the front component 305 and the rear component 310 is approximately 2 millimeters (mm) thick, although any other thickness appropriate to the contemplated shoe sole instead can be used. Often, the front component 305 will differ structurally from the rear component 310. For example, in the present case, front component 305 has a toe piece 306, while the rear component 310 has a heel piece 311.

For the purpose of attaching front component 305 and rear component 310, front component 305 is provided with a mating section 315, and rear component 310 is provided with a mating section 320. Preferably, such mating sections 315 and 320 allow front component 305 and rear component 310 to contact or attach to each other at a variety of different positions, thereby enabling the manufacturer to customize the length of the strap anchor 300. In the present embodiment, each of mating sections 315 and 320 is approximately 1-3 inches long and, more preferably, approximately 1.5-2 inches long, thereby providing approximately that amount of adjustability in the overall length of the strap anchor 300. As a result, a single pair of a front component 305 and a rear component 310 typically can be used for a range of shoe sizes (e.g., sizes 5-7 or 8-10). Although greater length adjustability can be used, width might also become an issue if a single pair of front component 305 and rear component 310 is used for too large a range of shoe sizes.

In the present embodiment, the front component 305 and the rear component 310 are attached to each other through the use of downwardly extending projections 316 on the mating section of one of the components (here, the mating section 315 of front component 305) and corresponding openings 321 on the mating section of the other component (here, the mating section 320 of rear component 310). In particular, the downwardly extending projections 306 fit inside openings 321 (e.g., snugly so that a secure snap fit or compression fit is achieved) and have the same uniform adjacent spacing as do openings 321.

As a result, in the present example, in which eight projections 316 and eight openings 321 are provided, maximum length is achieved by engaging only the outermost projection 316 with the outermost opening 321, and minimum length is achieved by engaging all eight projections 316 with all eight openings 321. In other words, eight possible lengths are accommodated in the present embodiment. In the specific example illustrated in the drawings (shown most clearly in FIG. 14), six of the projections 316 engage six of the openings 321 (e.g., at positions 323), resulting in the third-shortest length possible.

A separate adhesive material can be used in order to secure projections 316 into openings 321. However, such adhesive material usually can be omitted, particularly when the projections 316 and openings 321 are sized and shaped so as to provide a compression fit or snap fit.

Also, in the present embodiment, the mating section 320 occurs within a narrower groove within the main body portion 303 of rear component 310, and the mating section 315 is narrower than the rest of the main body portion 303 of front component 305. More specifically, mating section 315 has the same width as (or a somewhat narrower width than) the groove forming mating section 320. As a result, no overall increase in width occurs along the section where front component 305 and rear component 310 contact each other. Similarly, appropriate reductions in the thicknesses of mating sections 315 and 320 (as compared to with the normal thickness of the main body portion 303) mean that no increase in overall thickness along the section where front component 305 and rear component 310 attach to each other. In other words, where the strap anchor components overlap each other, at least one of said strap anchor components has an area that is thinner than an immediately adjacent area, thereby eliminating or reducing any increase in thickness that otherwise would occur.

It is noted that no arms 302 (or their corresponding strap-attachment points 304) are shown along with the mating sections 315 and 321 in the drawings. This omission primarily is to facilitate illustration of other aspects of strap anchor 300. However, in certain embodiments of the invention, one or more of such arms 302 (typically, pairs of such arms 302), having corresponding strap-attachment points 304, are provided along either or both of these mating sections 315 and 321. Then, in the event that a desired short length would cause an interference involving the arms 302 and/or strap-attachment points 304, one or more of the arms 302 can be simply cut (or otherwise trimmed) off.

Figure 15:
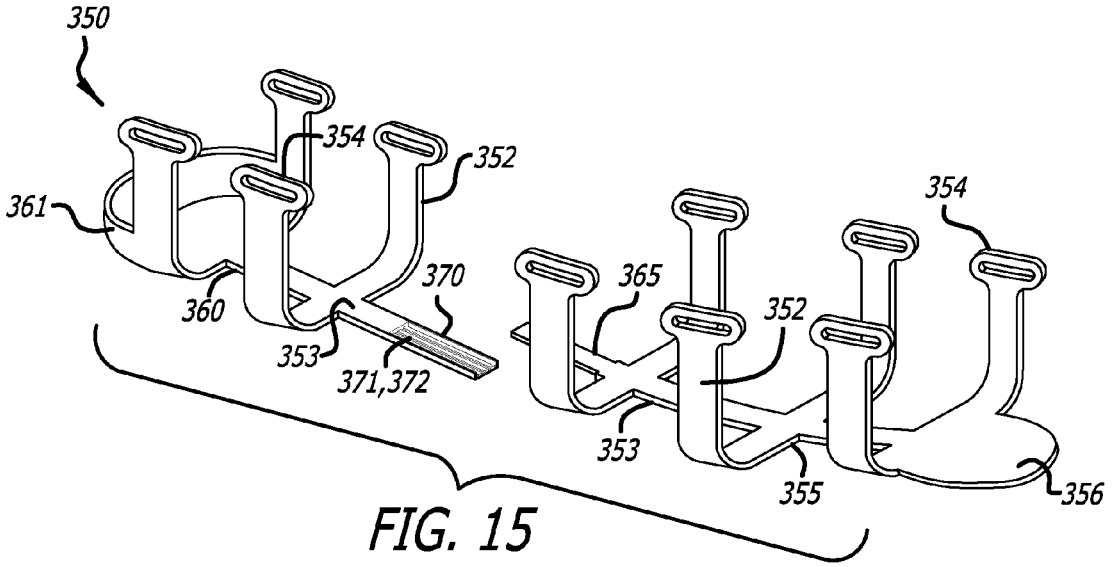
FIG. 15 is a perspective view of the separate components of a strap anchor according to another representative embodiment of the present invention.
Figure 16:
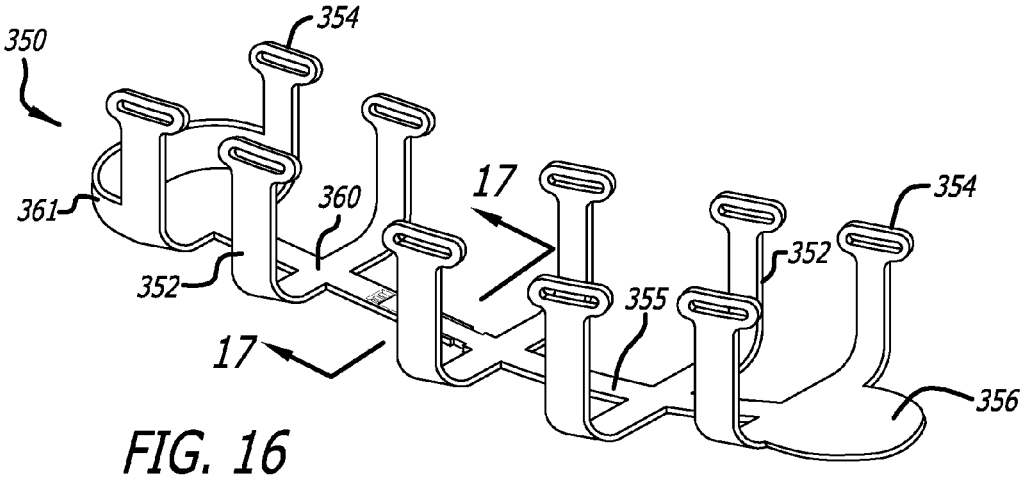
FIG. 16 is a perspective view of an assembled strap anchor using the components illustrated in FIG. 15.
Figure 17:
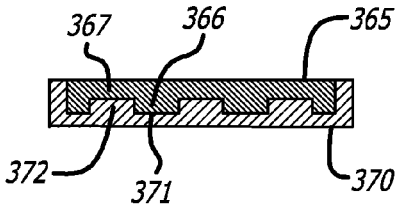
FIG. 17 is a cross-sectional view of a portion of the strap anchor shown in FIG. 16.

According to a second embodiment of a multi-component strap anchor 350, illustrated in FIGS. 15-17, a front component 355 and a rear component 360 are assembled together in order to form the entire strap anchor 350. As with the other strap anchors described above, strap anchor 350 preferably includes a main body portion (here, the main body portion 353), from which arms (here, arms 352) extend, each terminating in a strap-attachment point (here, strap-attachment points 354). As with the immediately preceding embodiment, in the present embodiment the arms 352, together with their respective strap-attachment points 354, are provided in two separate components, the front component 355 and the rear component 360. Once again, the front component 355 differs structurally from the rear component 360, with the front component 355 having a toe piece 356 and the rear component 360 having a heel piece 361 in the present embodiment.

For the purpose of attaching front component 355 and rear component 360, front component 355 is provided with a mating section 365, and rear component 360 is provided with a mating section 370. Preferably, such mating sections 365 and 370 allow front component 355 and rear component 360 to contact or attach to each other along a continuous range of different positions, thereby enabling the manufacturer to customize the length of the strap anchor 350 to any length within the permissible range.

In the present embodiment, such mating is accomplished through the use of one or more alternating ridges 366 and grooves 367 running along the length of mating section 365 and corresponding mating grooves 371 and ridges 372 running along the length of mating section 370. That is, ridges 366 fit within grooves 371 and ridges 372 fit within grooves 367 (e.g., either loosely or so as to form a compression or snap fit). Because there are no discrete connection points (as were present in the previous embodiment), it is possible to mate the front component 355 and rear component 360 at any position where their corresponding mating sections 365 and 370 overlap. In addition, particularly where the ridges fit loosely into their mating grooves, in certain embodiments it can be preferable to coat one or both surfaces with an adhesive material (e.g., a quick-drying cement) in order to help maintain the desired position (e.g., while embedding the strap anchor 350 within the shoe's sole).

Also, in the present embodiment, the mating section 370 occurs within a somewhat narrower part of main body portion 303 within rear component 360 and, correspondingly, the section of main body portion 353 in the front component 305 is narrower at mating section 365. As a result, no increase in width occurs along the section where front component 355 and rear component 360 contact each other. Similarly, as in the preceding embodiment, mating sections 365 and 370 are thinner than the respective immediately adjacent parts of the main body portion 303, so that there is no increase in thickness along the section where front component 305 and rear component 310 contact each other.

In certain embodiments of the invention, one or more arms 352 are provided along either or both of mating sections 365 and 370. Such arms 352 preferably then are simply cut (or otherwise trimmed) off if necessary or desired, e.g., if interference would be a problem. More generally, it is noted that, other than the differences in the mating structures, the features of, and the considerations pertaining to, the preceding embodiment also apply with respect to the present embodiment.

Figure 18:
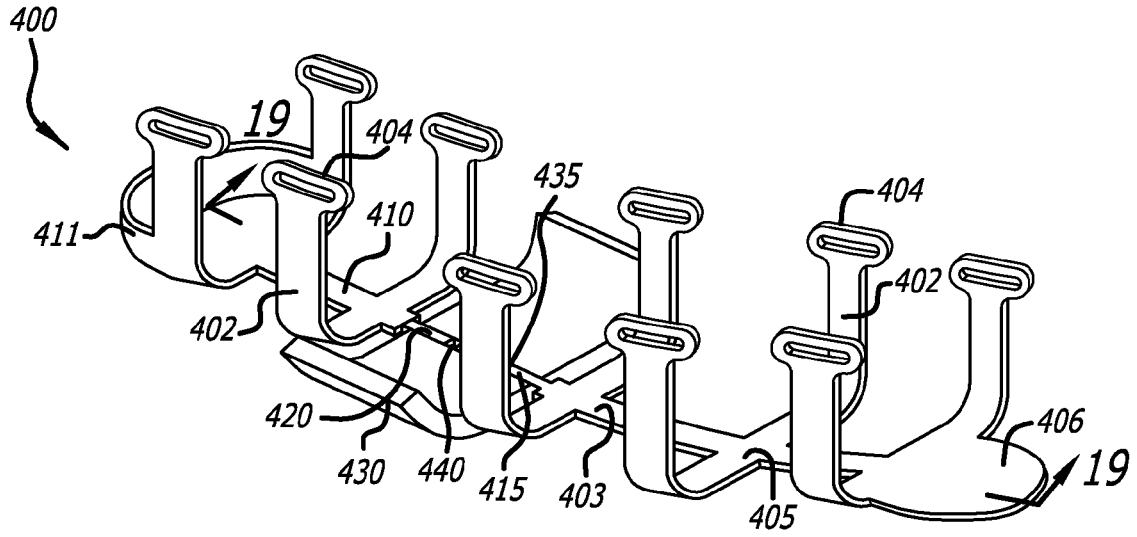
FIG. 18 is a perspective view of an assembled strap anchor using an intermediate component.
Figure 19:
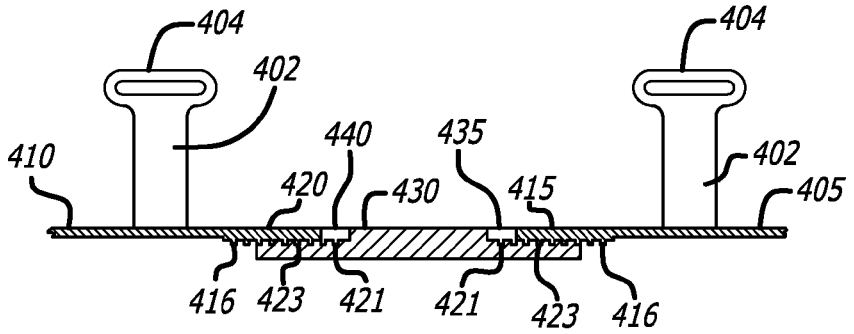
FIG. 19 is a cross-sectional view of a portion of the strap anchor shown in FIG. 18.

A third embodiment of a multi-component strap anchor 400 is illustrated in FIGS. 18-19. As in the preceding embodiments, each of the front component 405 and the rear component 410 includes arms 402 that extend from a main body portion 403 and that terminate in strap-attachment points 404. However, rather than directly contacting each other, in the present embodiment front component 405 and rear component 410 attach to (or simply contact) an intermediate component 430 (which in the present embodiment does not include any arm 402 or strap-attachment point 404), in order to form the entire strap anchor 400. More specifically, in the present embodiment, the intermediate component 430 includes sections 435 and 440 for mating with section 415 on front component 405 and with section 420 on rear component 410, respectively.

The specific mating configuration of the present embodiment is somewhat similar to the embodiment discussed above in connection with FIGS. 12-14. In the present embodiment, the mating sections 415 and 420 (on the front component 405 and rear component 410, respectively) include downward projections 416, and the mating sections 435 and 440 (on intermediate component 430) include openings 421. In the specific example illustrated in the drawings (shown most clearly in FIG. 19), five of the seven projections 416 on mating section 415 of front component 405 engage five of the seven openings 421 in mating section 435 of intermediate component 430, and five of the seven projections 416 on mating section 420 of rear component 410 engage five of the seven openings 421 in mating section 440 of intermediate component 430 (e.g., at positions 423).

It is noted that the number of engaged positions 423 can vary between the front component 405 and the rear component 410. In fact, in alternate embodiments even the number of projections 416 can vary between the front component 405 and the rear component 410 (e.g., with corresponding differences in the number of openings 421 in mating section 435 as compared to mating section 440). In addition, in alternate embodiments of the invention, any other mating sections for adjusting the length of the strap anchor 400 instead may be provided on intermediate component 430 and either or both of front component 405 and rear component 410 (e.g., using mating sections that are similar to mating sections 365 and 370, discussed above).

In the preferred embodiments of the invention, intermediate component 430 serves a structural purpose within the shoe's sole, such as being configured as an arch support (e.g., thicker, stronger, harder and/or more contoured than front component 405 and rear component 410). As with the other multi-component strap anchors discussed above, the front component 405 differs structurally from the rear component 410, with the front component 405 having a toe piece 406 and the rear component 410 having a heel piece 411 in the present embodiment.

In certain embodiments of the invention, one or more arms 402 also are initially provided along either or both of mating sections 415 and 420. Such arms 402 preferably then are simply cut (or otherwise trimmed) off if necessary or desired, e.g., if interference would be a problem.

In still further embodiments of the invention, any number of components may be used to form a strap anchor (e.g., contacting each other lengthwise). Preferably, such components include at least one mating section pair, configured so that the corresponding components can mate at various positions, thereby providing the overall strap anchor with variable length. However, in order to reduce manufacturing costs, the number of components typically will be limited to two or three.

As indicated above, it ordinarily is preferable to provide some means (e.g., a snap fit or use of adhesive material) to prevent the individual components of the multi-component strap anchor from moving relative to each other during the process of incorporating the strap anchor into the shoe's sole. However, depending upon the particular embodiment, prevention of such relative movement may be less important and, in some cases, such relative movement might even be desirable in order to allow for minor adjustments when embedding the strap anchor within the shoe's sole.

Finally, certain specific mating surfaces have been described above and illustrated in the drawings. However, the specific mating surfaces should be seen as merely exemplary. Any other mating surfaces, preferably providing for variable positioning, instead can be used (e.g., using tabs and slots or tongues and grooves).

Strap Anchors Without a Central Spine.

In the embodiments described above, the strap anchor typically includes a central spine that joins together a number of arms, each such arm terminating in one or more loops. However, in alternate embodiments the central spine is omitted. For example, according to one such embodiment, the strap anchor includes multiple separate (e.g., unattached) components, each having a proximal end that is embedded within the shoe's sole and a distal end that is provided with one or more loops.

Figure 20:
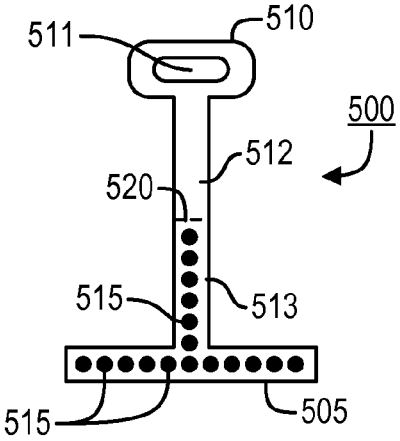
FIG. 20 is a top plan view of a strap anchor component according to a representative embodiment of the present invention.
Figure 21:
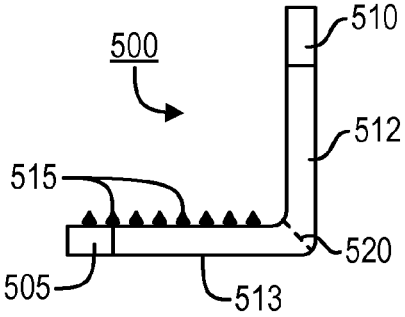
FIG. 21 is a side elevational view of the strap anchor component shown in FIG. 21 bent at a 90° angle along line 520.

An example of a single such strap anchor component 500 is illustrated in FIGS. 20 and 21. As shown, strap anchor component 500 includes a proximal end 505 and a distal end 510, joined together by a segment that includes an upper portion 512 and a lower portion 513. Proximal end 505 preferably is configured as a cross member, e.g., so that lower portion 513 and proximal end 505 together form a "T". In the present embodiment, lower portion 513 and proximal end 505 also include a plurality of outwardly extending members 515 (e.g., shaped as bumps, cones or spikes). Distal end 510 includes at least one loop 511 or other strap-attachment point(s).

In FIG. 20, strap anchor component 500 is shown as being flat, e.g. as initially manufactured. Bending along line 520 (e.g., by applying heat and bending force at that point) results in the configuration shown in FIG. 21, in which upper portion 512 is oriented at an angle to lower portion 513 (preferably, an angle of approximately 90°). Alternatively, rather than being initially manufactured flat and then subsequently bent, strap anchor component 500 could be initially manufactured as shown in FIG. 21.

When in use, lower portion 513 and proximal end 505 extend into the shoe's sole. As will be readily apparent, the cross member (e.g., T-shaped) configuration of proximal end 505 and the outwardly extending members 515 grip the base material of the shoe's sole, resisting any forces that otherwise would tend to pull strap anchor component 500 out of the shoe's sole. However, in alternate embodiments either such feature may be used separately and/or any other structure may be used to securely anchor the individual strap anchor components 500 into the base material of the shoe's sole.

Generally speaking, each individual strap anchor component 500 is similar to a single arm 12 of strap anchor 10. However, rather than being connected together through a central spine 13, each strap anchor component 500 preferably is itself anchored within the base material of the shoe's sole, e.g., through the use of the described T-shaped configuration and the outwardly extending members 515. In other words, in the present embodiments the strap anchor is comprised of a number of separate strap anchor components 500. It is further noted that the strap anchor components 500 can be embedded into the shoe's sole using any of the techniques described above. As with the other strap anchors described above, the individual strap anchor component 500 preferably is made of a strong and rigid or semi-rigid material, such as any of the specific materials mentioned above.

Figure 22:
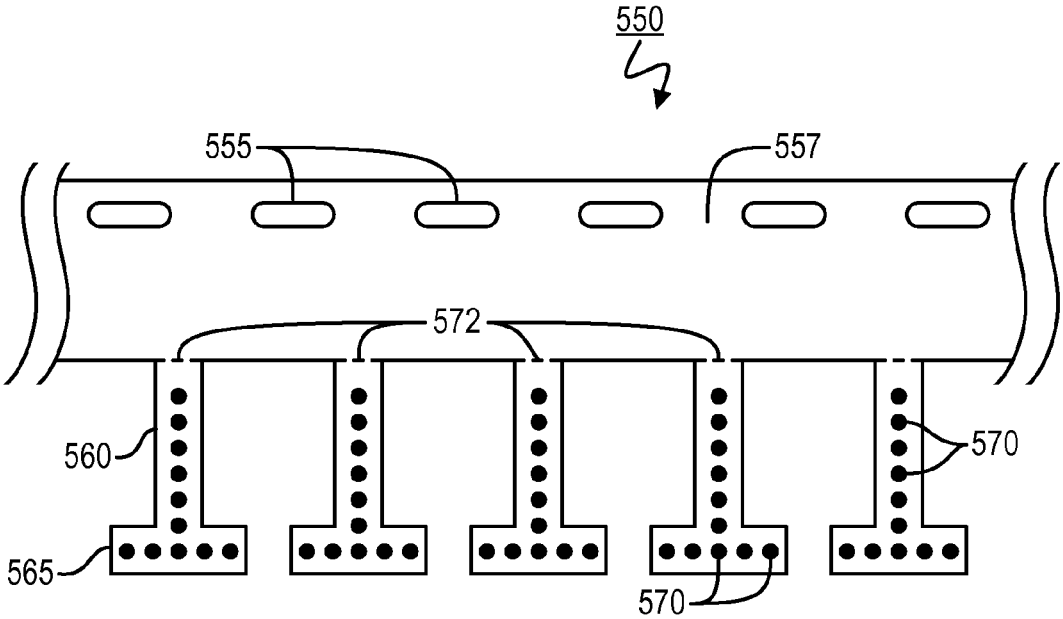
FIG. 22 is a top plan view a portion of a strap anchor according to a representative embodiment of the present invention.

In most of the embodiments described above, the strap-attachment points are disposed at the ends of separate arms. FIG. 22 illustrates a portion of a strap anchor 550 in which the loops 555 (or other strap-attachment points) are disposed along the top edge of a continuous strip 557 of material. The bottom edge of strip 557 is provided with an anchor mechanism for embedding into the base material of the shoe's sole. In the present embodiment, this anchor mechanism includes a plurality of extending members 560, each terminating in a cross member 565 (e.g., T-shaped), with both the extending members 560 and cross members 565 having a plurality of outwardly extending elements 570. As in the previous embodiment, cross number 565 and outwardly extending elements 570 grip into the base material of the shoe's sole. Also, in the present embodiment either such feature may be used separately and/or any other structure may be used to securely anchor strap anchor 550 into the base material of the shoe's sole.

Strap anchor 550 is shown in FIG. 22 as being entirely flat, which is how it might be initially manufactured. In this case, the anchoring members 560 preferably are bent inwardly, e.g., along lines 572 using heat and appropriate bending force. Alternatively, strap anchor 550 can be initially manufactured such that strip 557 is angled relative to anchoring members 560 (e.g., at an angle of approximately 90°). In any event, preferably with this angled configuration, one or more such strips are disposed along at least a portion of the side edges of the shoe, e.g., using any of the techniques mentioned above, with the anchoring members 560 extending into the base material of the shoe's sole.

Given the configuration of strip 557 and the desire for it to conform to the edge of the shoe's sole, the material from which it is made preferably is somewhat less rigid than the material used for some of the other strap anchors described herein. In one embodiment, strap 557 is made of Kevlar or a wire mesh material, so that it is more easily shaped to conform to the appropriate segment of the side edge(s) of the shoe's sole.

It is noted that the same strip 557 also can be used in a strap anchor that has a central spine (or other central connecting member). In this case, rather than using a number of separate T-shaped anchoring members, e.g., a number of extending members 560 still could be used, but in this case they would be connected together to a central spine or to some other connecting structure. In fact, in any of the embodiments discussed herein in which a central spine is used, that central spine can be replaced with any other kind of connecting structure, such as a mesh structure.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe, comprising:

a sole comprised of a base material;

a strap anchor made of a second material that is stronger and more durable than the base material and having: (1) a central elongated section embedded within the base material of the sole so as to be hidden from view, and (2) a plurality of projections extending from sides of the central elongated section, emerging from left and right sides of the sole, and providing attachment points on said left and right sides of the shoe;

a strap that is at least one of attached to and looped through at least one of the attachment points and that is configured for strapping the shoe to a wearer's foot; and an upper extending above the sole, wherein the projections extend up into and are embedded within the upper.

2. A shoe according to claim 1, wherein the strap includes an attachment mechanism at its distal end.

3. A shoe according to claim 2, wherein the attachment mechanism comprises at least one of a high-density-hook mechanism and a high-density-loop mechanism.

4. A shoe according to claim 1, wherein a front portion of the central elongated section of the strap anchor is at least one of stronger and more rigid than other portions of the strap anchor.

5. A shoe according to claim 1, wherein said projections are configured as relatively long and narrow arms.

6. A shoe according to claim 1, wherein a plurality of straps fixedly attach to different ones of the attachment points.

7. A shoe according to claim 1, wherein the base material has been molded around the central elongated section of the strap anchor.

8. A shoe according to claim 1, wherein the base material has been blown with air so as to include a plurality of small air pockets that make the base material more cushiony and less dense.

9. A shoe according to claim 8, wherein the sole is made entirely of the base material.

10. A shoe according to claim 1, wherein said projections extend at approximately right angles from the left and right sides of the central elongated section.

11. A shoe according to claim 10, wherein a plurality of the projections terminate in the attachment points.

12. A shoe according to claim 11, wherein the central elongated section is relatively long and narrow.

13. A shoe according to claim 1, wherein the attachment points comprise at least one of loops and slots.

14. A shoe according to claim 1, wherein the strap anchor is a unitary piece.

15. A shoe according to claim 1, wherein the attachment points are disposed along an outside perimeter of a top portion of the sole.

16. A shoe according to claim 1, wherein the attachment points are just slightly above the sole.

17. A shoe according to claim 1, wherein the base material is a single kind of material.

18. A shoe according to claim 1, wherein the shoe has a main body structure that, other than the embedded strap anchor, is made entirely of the very lightweight base material.

* * * * *